United States Patent [19]

Umezawa et al.

[11] 4,441,531

[45] Apr. 10, 1984

[54] WEFT DETAINING DEVICE OF SHUTTLELESS LOOM

[75] Inventors: Hidetsugu Umezawa, Higashiyamato; Takashi Ogasawara, Tokyo; Haruo Shimazaki, Tachikawa, all of Japan

[73] Assignee: Nissan Motor Co., Ltd., Yokohama, Japan

[21] Appl. No.: 283,688

[22] Filed: Jul. 15, 1981

[30] Foreign Application Priority Data

Jul. 21, 1980 [JP] Japan ..... 55-98649
Sep. 9, 1980 [JP] Japan ..... 55-123998

[51] Int. Cl.[3] ..... D03D 47/36
[52] U.S. Cl. ..... 139/452; 242/47.01
[58] Field of Search ..... 139/452; 242/47.01, 242/47.12, 47.13; 66/132 R

[56] References Cited

U.S. PATENT DOCUMENTS 3,455,341 7/1969 Pfarrwaller ..... 139/452
4,180,215 12/1979 Nurk ..... 242/47.01
4,238,080 12/1980 Van Mullekom ..... 242/47.01

FOREIGN PATENT DOCUMENTS 1925602 1/1970 Fed. Rep. of Germany ..... 139/452
1042868 9/1966 United Kingdom ..... 139/452
2027070 2/1980 United Kingdom ..... 139/452

*Primary Examiner*—Henry Jaudon
*Attorney, Agent, or Firm*—Thompson, Birch, Gauthier & Samuels

[57] ABSTRACT

A weft detaining device of a shuttleless loom, comprises a drum on which a weft yarn is wound predetermined times prior to a weft picking through a weft picking means, the drum being constituted by a plurality of separate and independent pieces, a support member on which the drum separate pieces are securely supportable, and a device for allowing the location of each drum separate piece to be movable relative to the support member so that the outer diameter of the drum is adjustable, thereby making possible changing a weft picking length by merely changing the location of each drum separate piece, without replacing the drum with the other drum having a different diameter or using any members to be mounted on the peripheral surface of the drum to adjust the outer diameter of the drum.

28 Claims, 16 Drawing Figures

WEFT DETAINING DEVICE OF SHUTTLELESS LOOM

BACKGROUND OF THE INVENTION

This invention relates to a weft detaining device of a shuttleless loom, of the type wherein a weft yarn is detained by being wound a certain number of times around a drum prior to a weft picking, and more particularly to the drum type weft detaining device which is provided with a device for adjusting the length of the weft yarn detained around the drum which length corresponds to a weft yarn length required for each weft picking.

In connection with conventional drum type weft detaining devices of shuttleless loom, changing the weft yarn length required for each weft picking or the detained amount of the weft yarn has been accomplished by replacing a drum for detaining the weft yarn with another drum whose outer diameter is different from the former drum, otherwise by increasing or decreasing the number of outer diameter adjusting members to be mounted on the peripheral surface of the drum. However, such conventional weft detaining devices have encountered problems in which it is required to prepare many drums having different sizes or many outer diameter adjusting members. This is uneconomical, rendering the operation and maintenance of the weft detaining device difficult and complicated.

BRIEF SUMMARY OF THE INVENTION

In accordance with the present invention, a weft detaining device of a shuttleless loom, consists of a drum disposed between a weft source and a weft picking device and on which a weft from the weft source is wound a predetermined number of times prior to a weft picking. The drum is constituted by a plurality of separate and independent pieces which are securely supportable on a support member. The location of each separate piece is movable relative to the support member so that the outer diameter of the drum is adjustable. With this arrangement, changing a weft yarn amount detained on the drum or a weft yarn length required for each weft picking can be accomplished only by moving the location of each separate drum piece to adjust the outer diameter of the drum, thereby rendering unnecessary preparing many drums having different diameters or many outer diameter adjusting members to be mounted on the peripheral surface of a drum.

BRIEF DESCRIPTION OF THE DRAWINGS

The features and advantages of the weft detaining device according to the present invention will be more clearly appreciated from the following description taken in conjunction with the accompanying drawings in which like reference numerals designate like parts and elements, and in which.

DETAILED DESCRIPTION OF THE EMBODIMENTS OF THE INVENTION

Figure 1:
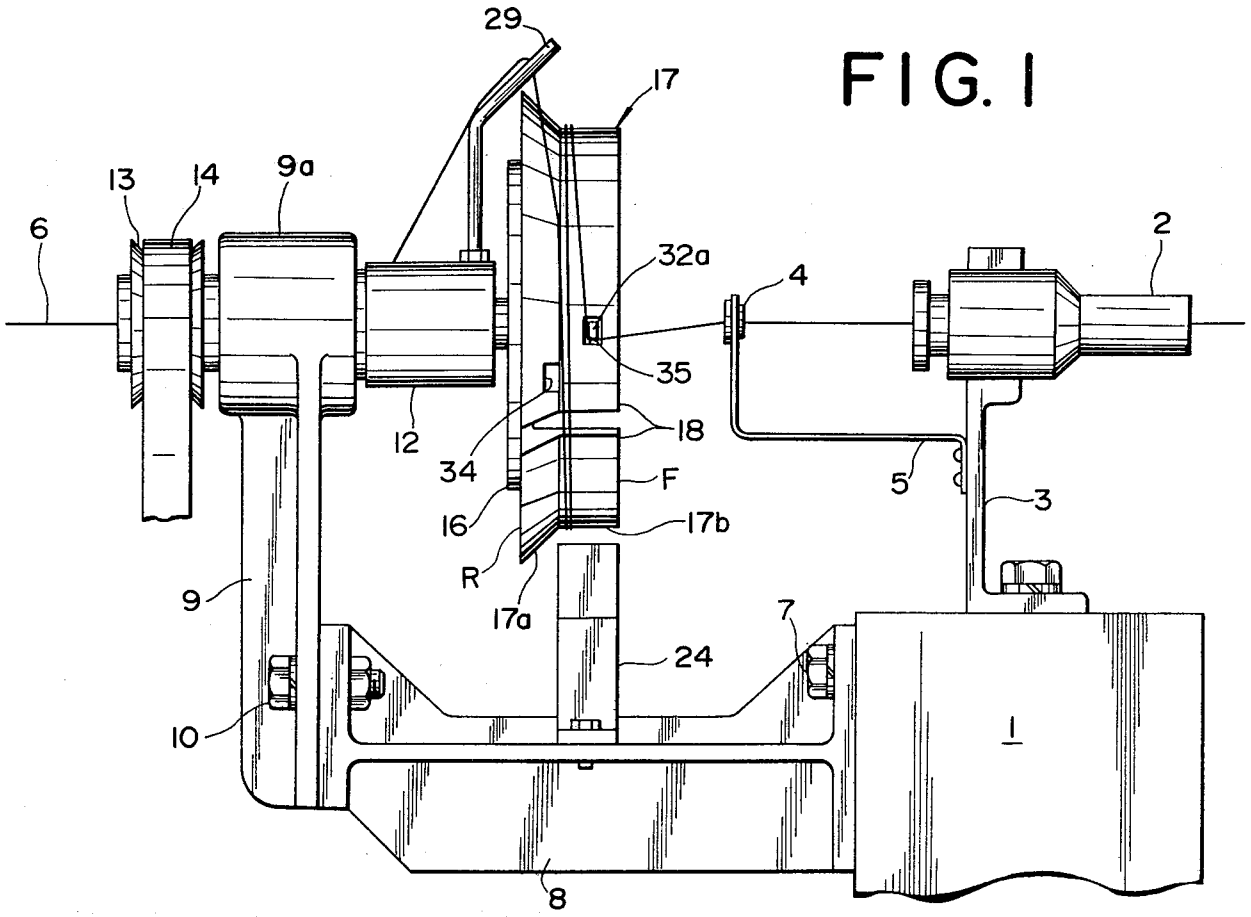
FIG. 1 is a front elevation of a first embodiment of a weft detaining device of a shuttleless loom, in accordance with the present invention.
Figure 2:
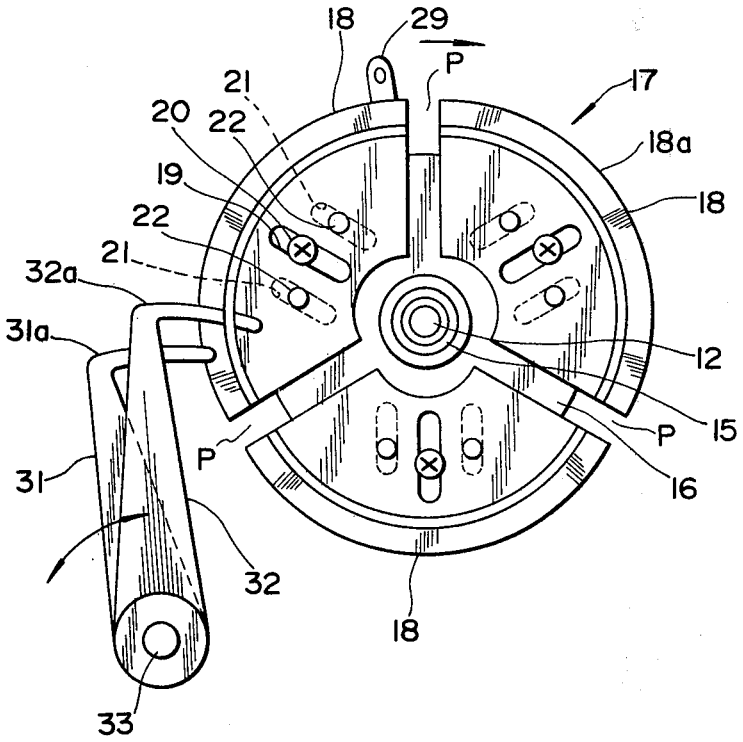
FIG. 2 is a side elevation of an essential part of the weft detaining device of FIG. 1.
Figure 3:
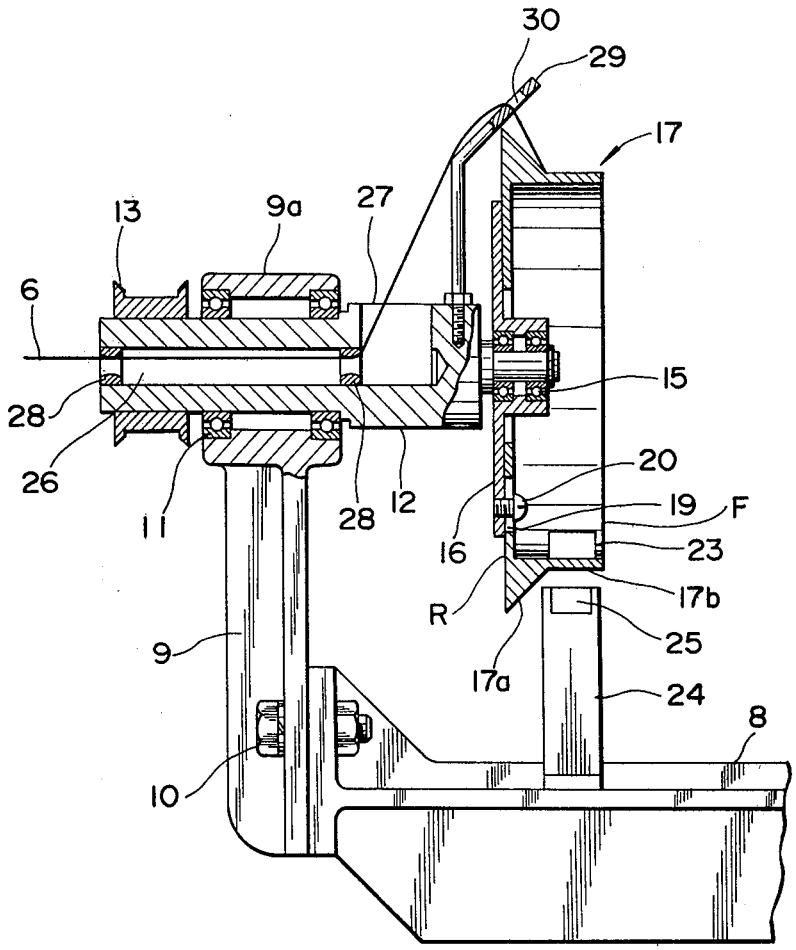
FIG. 3 is a vertical cross-section of the essential part of the weft detaining device of FIG. 1.

Referring now to FIGS. 1 to 3 of the drawings, there is shown a first embodiment of a weft detaining device of a shuttleless loom, in accordance with the present invention. The shuttleless loom consists of a weft inserting air injection nozzle 2 which is supported by a nozzle holder 3 which is fixed on a frame 1 of the shuttleless loom. A weft guide 4 is supported by a stay 5 which is secured to the nozzle holder 3, and located rearward of the nozzle 2 so that the axis thereof is in alignment with that of the nozzle 2. Accordingly, a weft yarn 6 drawn out from the weft detaining device which will be discussed hereinafter is introduced into the nozzle 2 through the weft guide 4, and then picked or inserted into a warp shed (not shown) under the influence of air injected from the weft inserting nozzle 2.

A bracket 9 having a bearing section **9*a* is secured to the frame 1 of the shuttleless loom through a horizontally disposed bracket 8 which is directly secured to the frame of the loom by bolts 7, as shown in FIG. 1. The bracket 9 is connected at its bottom part to the bracket 8 with bolts 10 and nuts (no numeral) so that the axis of the bearing section 9*a* is in alignment with that of the weft guide 4. A shaft 12 is rotatably supported at its central section within the bearing section 9*a* by ball bearings 11 as shown in FIG. 3. A toothed pulley 13 is fixedly mounted on a rear section of the rotatable shaft 12. A toothed belt 14 is provided to connect the pulley 13 and a drive pulley (not shown) to rotate the rotatable shaft in timed relation to the operation of the loom. The illustration of the weft detaining device will be made hereinafter in the case where the transmission ratio or a ratio between the rotation of the rotatable shaft 12 and the operational cycle of the loom is 3:1, in which the rotatable shaft 12** rotates three times per each operational cycle of the loom.

A support member 16 is mounted through ball bearings 15 on a front end section of the rotatable shaft 12 so as to be rotatable relative to the rotatable shaft 12. A drum 17 forming part of the weft detaining device is fixedly attached on the support member 16. The drum 17, in this instance, is constituted by three separate and independent pieces 18 each of which is generally in the form of a sector in cross-section as clearly shown in FIG. 2. Accordingly, each separate piece 18 has an arcuate section 18*a* (as shown in FIG. 2) which constitutes a peripheral surface of the drum 17. Each separate piece 18 is formed with an elongate opening 19 which extends in the radial direction of the drum 17. Each separate piece 18 is fixed onto the support member 16 by a small screw 20 which is screwed in the support member 16 and located within the elongate opening 19 so that the location of the separate piece 18 is movable and adjustable relative to the support member 16 by loosing the small screw 20. In this connection, the support member 16 is formed with pairs elongate guide openings 21 which are parallel with the elongate hole 19 of each piece 18. Two guide pins 22 project from each separate piece 18 into the respective guide opening 21. Accordingly, all the separate pieces 18 are movable in the radial direction of the drum 17 so that the outer diameter of the drum 17 is variable. It will be understood that three radial straight apertures P are formed between the side surfaces of the adjacent pieces 18 of the drum 17 when each separate piece 18 is moved radially and outwardly to enlarge the outer diameter of the drum 17. The drum 17 and accordingly each separate piece 18 is formed at its peripheral surface with a frustoconical section 17*a* whose outer diameter gradually decreases in the direction from the rear end face R to the front end face F of the drum 17, and a cylindrical section 17*b* which is integrally connected to the smallest-diameter part of the frustoconical section 17*a* with the same diameter as in the frustoconical section smallest-diameter part. The outer diameter of the cylindrical section 17*b* is so set that the length of the weft yarn wound three times around the cylindrical section 17*b* corresponds to a weft yarn length required for each weft picking. Additionally, a magnet 23 is securely disposed at the inside surface of the drum 17. This magnet 23 is opposite to a magnet 25 securely supported at the tip section of a support 24 planted on the bracket 8, which magnet 25 is located outside of the drum 17. As shown, the magnet 25 is spaced apart from the outer peripheral surface of the drum 17, but a magnetic attraction is generated between the two magnets 23, 25 so that the drum 17 is maintained at a stationary state regardless of the rotation of the rotatable shaft 12.

The rotatable shaft 12 is formed with an elongate weft introduction hole 26 which extends along the axis of the rotatable shaft 12 and is opened to the rear end face of the rotatable shaft 12. The rotatable shaft 12 is further formed at its peripheral surface with a vertical weft outlet hole 27 which is in communication with the weft introduction hole 26. The reference numeral 28 denotes guide bushings for the weft yarn passing through the weft introduction hole 26. Fixed onto the peripheral surface of the rotatable shaft 12 forward of the weft outlet hole 27 is a weft guide member 29 whose tip section is obliquely bent to approach the surface of the frustoconical section 17*a* of the drum 17. The weft guide member 29 is formed at its tip section with a weft guide opening 30 through which the weft yarn 6 from the weft outlet hole 27 is guided onto the peripheral surface of the frustoconical section 17*a* therearound when the weft guide member 29 rotates around the drum 17 with the rotation of the rotatable shaft 12. Accordingly, the weft yarn 6 drawn out from a weft supply means or weft source (not shown) such as a weft supply bobbin is passed through the weft introduction hole 26 and the weft outlet hole 27, and introduced along the surface of the weft guide member 29 to the weft guide opening 30. After being passed through the weft guide opening 30, the weft yarn 6 is guided onto the peripheral surface and wound around the frustoconical and cylindrical sections 17*a*, 17*b* of the drum 17 when the weft guide member 29 rotates with the rotation of the rotatable shaft 12, in which the weft yarn 6 is caught by at least one of first and second hook levers which will be discussed hereinafter, and passed through the guide 4.

Figure 9:
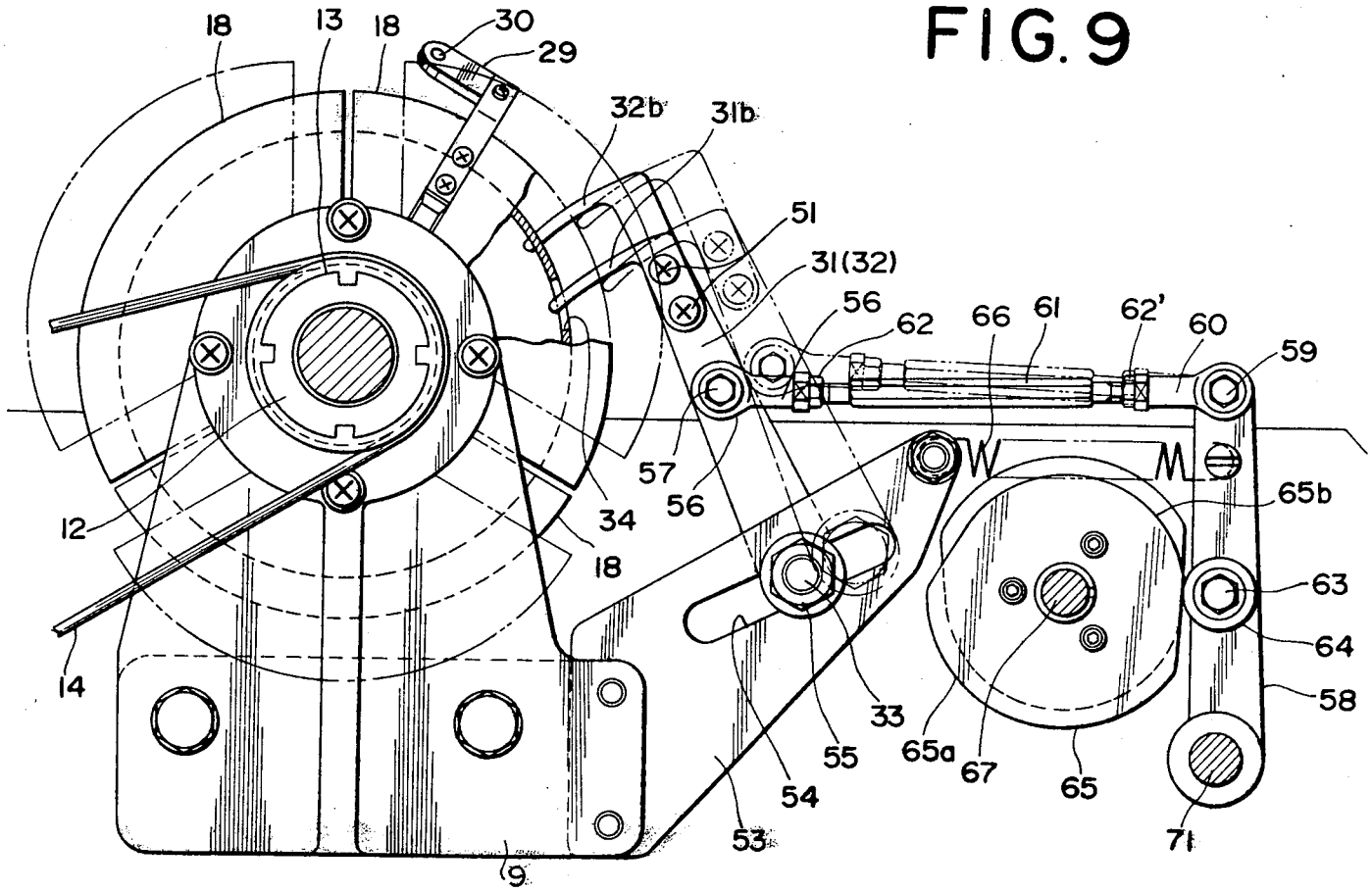
FIG. 9 is a side elevation of the weft detaining device of FIG. 1.
Figure 10:
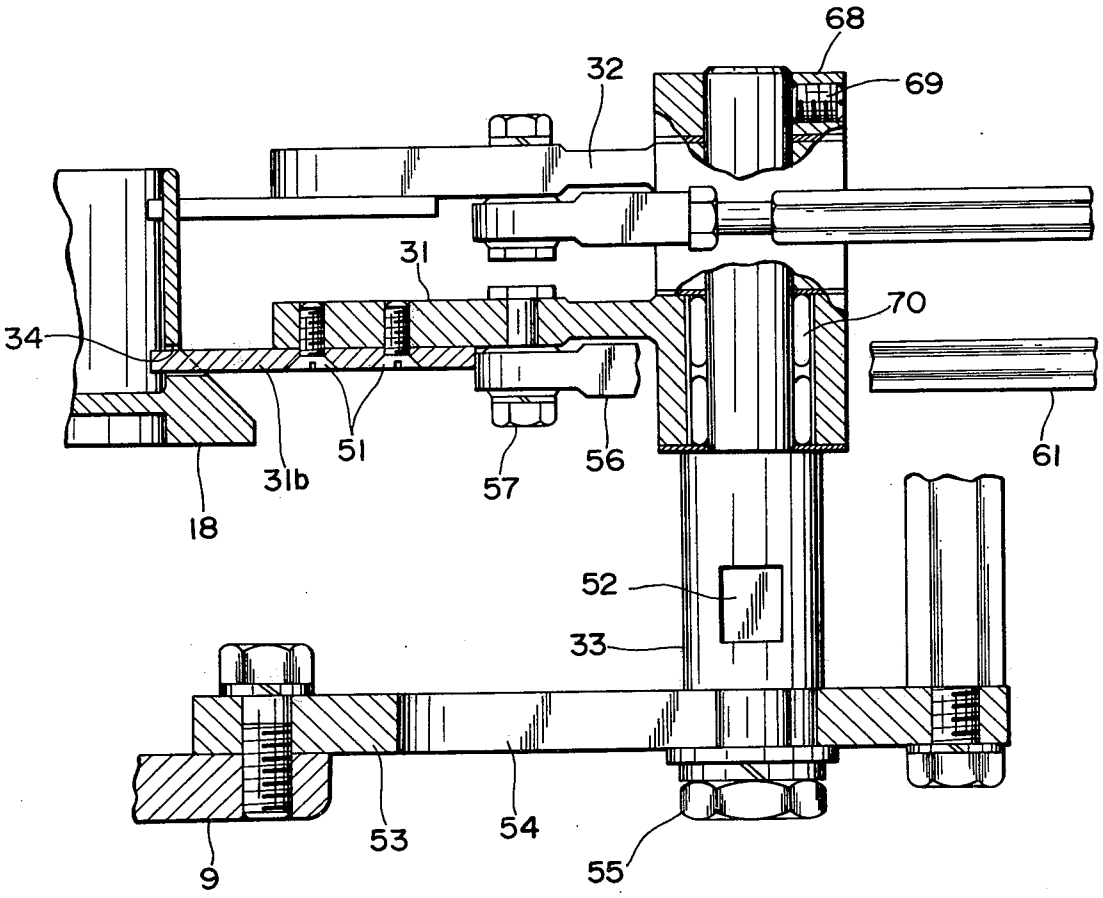
FIG. 10 is a plan view partly in section of an essential part of the weft detaining device of FIG. 9.
Figure 11:
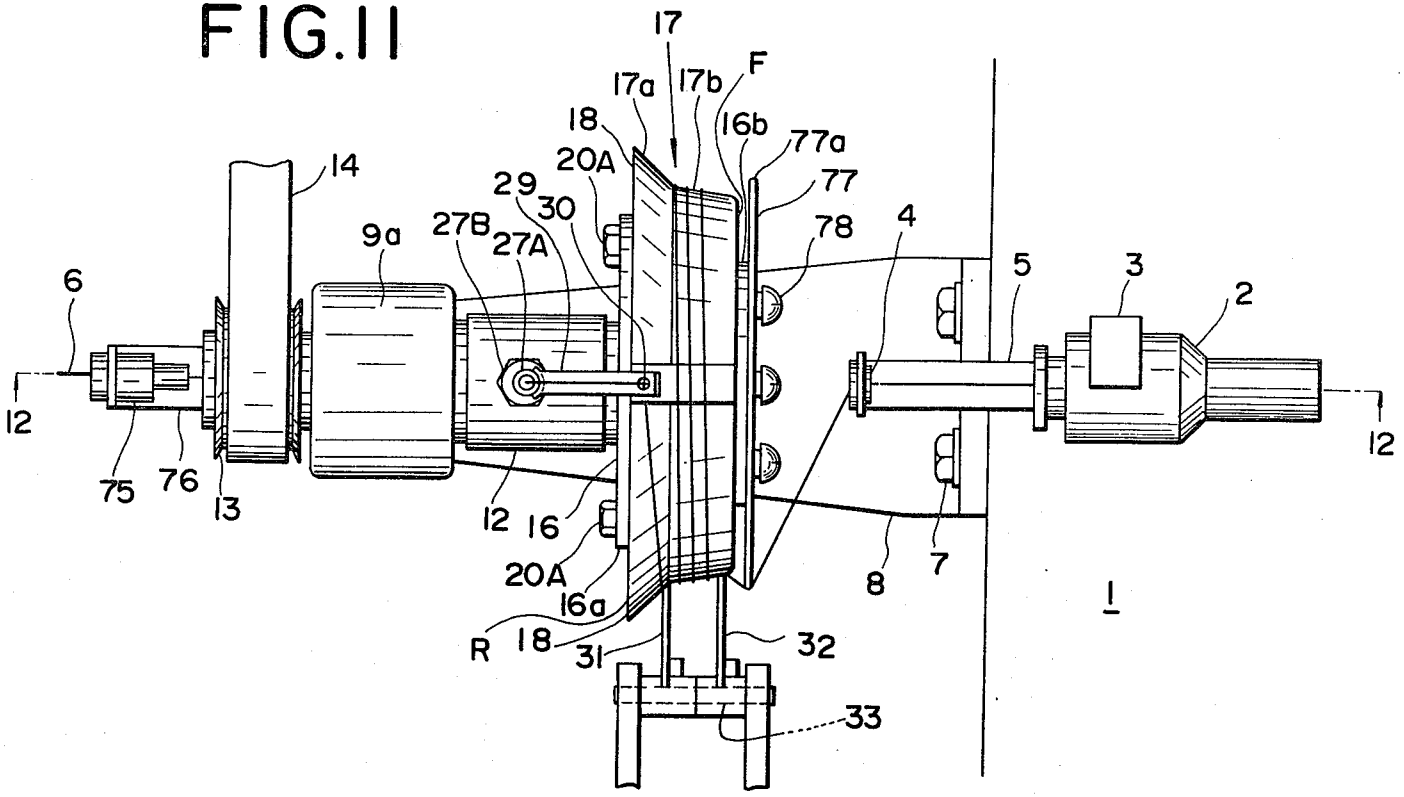
FIG. 11 is a plan view of a fifth embodiment of the weft detaining device in accordance with the present invention.
Figure 12:
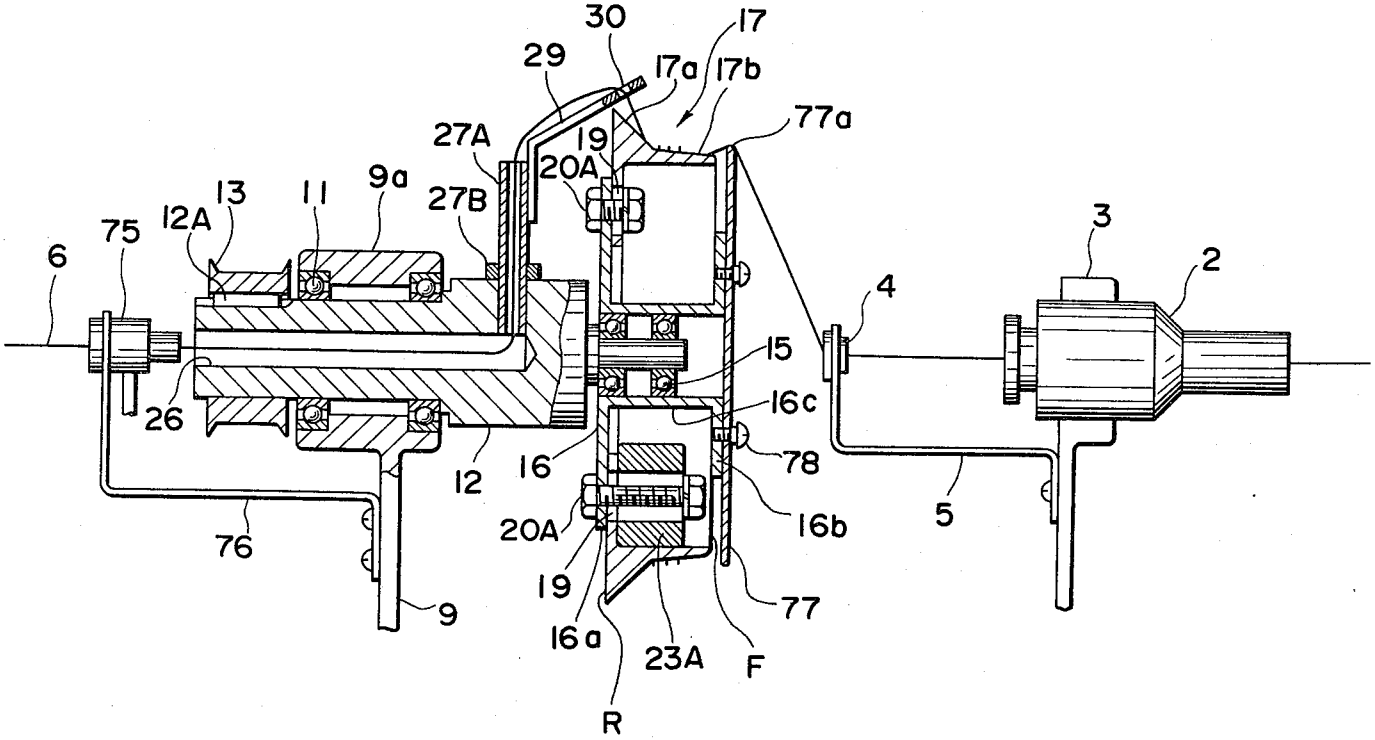
FIG. 12 is a vertical cross-sectional view taken in the direction of the arrows substantially along the line 12—12 of FIG. 11.
Figure 13:
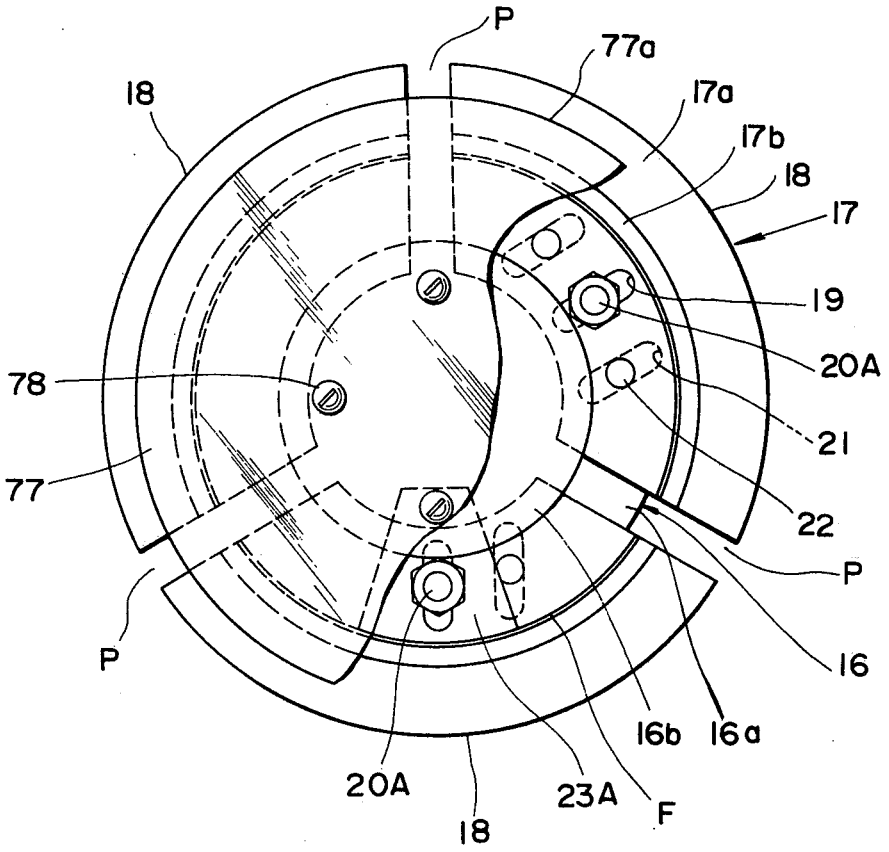
FIG. 13 is an enlarged side view of an essential part of the weft detaining device of FIG. 11.
Figure 14:
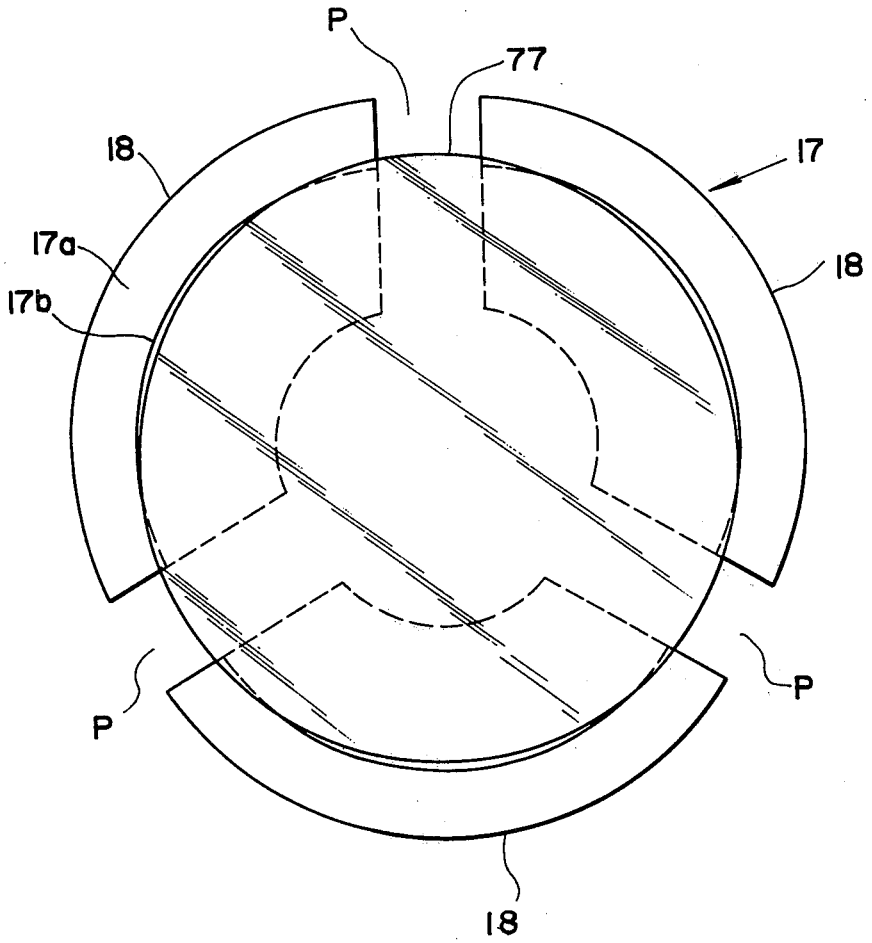
FIG. 14 is a schematic illustration similar to FIG. 13, but showing the locational relationship between a drum and a weft guide member of the weft detaining device of FIG. 11.

The first and second hook levers 31, 32 are rotatably and pivotally mounted on a fixed shaft 33 as shown in FIG. 2, and formed respectively with first and second hook sections 31*a*, 32*a*. The first hook lever 31 is so movably located that the first hook section 31*a* faces a through-hole 34 formed in the vicinity of the border between the frustoconical and cylindrical sections 17*a*, 17*b* and can be projected into the through-hole 34. Similarly, the second hook lever is so movably located that the second hook section 32*a* faces a through-hole 35 formed at the cylindrical section 17*b* and can be projected into the through-hole 35. The first and second hook levers 31, 32 are constructed to be swingably moved independently from each other, toward and away from the drum 17 so that each hook section 31*a*, 32*a* projects into and withdraws from the corresponding through-hole 34, 35 in accordance with a predetermined time schedule in timed relation to an operational cycle of the loom. An example of an arrangement for thus moving the first and second hook levers 31, 32 will be explained after with reference to FIGS. 9 and 10.

The manner of operation of the weft detaining device will be discussed hereinafter.

During the operation of the loom, the rotatable shaft 12 is rotated three times per an operational cycle of the loom; however the drum 17 is not rotated due to the magnetic attraction generated between the magnet 23 within the drum 17 and the magnet 25 on the support 24. Accordingly, with the rotation of the rotatable shaft 12, the weft guide member 29 rotates around the drum 17, so that the weft yarn 6 is wounded around the frustoconical section 17*a* of the drum 17. Then, the weft yarn 6 wound around the frustoconical section 17*a* slides down along the slope of the frustoconical section 17*a* by virtue of the tension applied to the weft yarn and moves to the cylindrical section 17*b* pushing forward the weft yarn located ahead thereof.

When the operational cycle of the loom reaches a time point immediately before the weft picking, the hook sections 31*a*, 32*a* of the first and second hook levers 31, 32 project into the through-holes 34, 35, respectively. In this state, the weft yarn 6 is caught by the hook section 31*a* of the hook lever 31 and thereafter caught by the hook section 32*a* of the hook lever 32 after being wound three times around the cylindrical section 17*b* of the drum 17. When the operational cycle of the loom further progresses, the hook section 32*a* of the second hook lever 32 withdraws from the through-hole 35 of the drum 17 to release the catching action on the weft yarn 6, so that the weft yarn 6 is picked under the influence of an air injection which starts immediately before the withdrawal of the hook section 32*a*. When the amount of the wound weft yarn on the cylindrical section 17*b* of the drum 17 becomes nothing or zero by this weft picking, the weft yarn 6 is caught by the hook section 31*a* of the first hook lever 17 to complete the weft picking. Since the weft guide member 29 rotates about one time around the drum 17 during this weft picking, the weft yarn 6 is wound around the frustoconical section 17*a* at the rear side relative to the hook section 31*a*.

Immediately thereafter, firstly the hook section 32*a* of the second hook lever 32 again projects into the through-hole 35 of the drum 17, and subsequently the hook section 31*a* of the hook lever 31 withdraws from the through-hole 34 of the drum 17. As a result, the weft yarn 6 wound around the frustoconical section 17*a* slides down along the slope of the section 17*a* and moves to the cylindrical section 17*b*, thereby being caught by the hook section 32*a* of the second hook lever 32. When the weft yarn 6 is wound about three times around the cylindrical section 17*b* of the drum 17, the hook section 31*a* of the first hook lever 31 projects into between a weft yarn section wound around the frustoconical section 17*a* and a weft yarn section wound around the cylindrical section 17*b* so as to separate them from each other. Immediately after this, the weft picking takes place.

In this weft detaining device, since a weft yarn length required for each weft picking corresponds to a length of the weft yarn wound about three times the drum 17 between the first and second hook levers 31, 32, a detained amount of weft yarn or the weft yarn length for the weft picking can be changed by varying the outer diameter of the drum 17. Varying the drum outer diameter is accomplished by suitably moving the respective separate pieces 18 in the radial direction of the drum upon loosing the small screws 20, in which the small screws 20 will be fastened when a desired outer diameter of the drum 17 is obtained.

Figure 4:
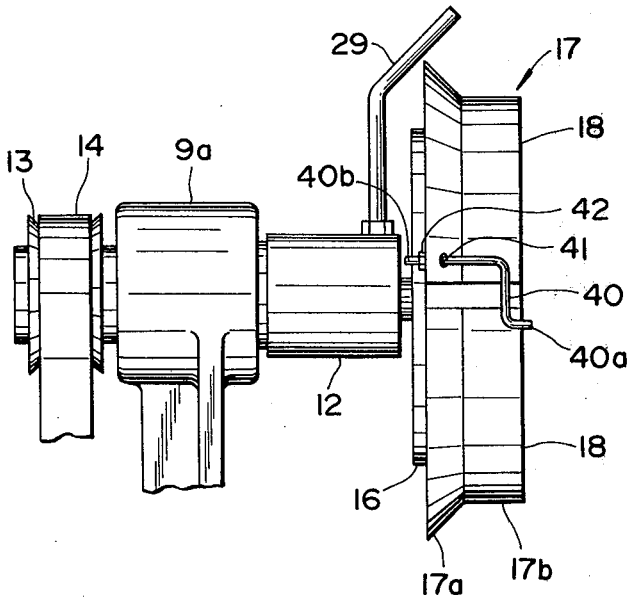
FIG. 4 is a front elevation of an essential part of a second embodiment of the weft detaining device in accordance with the present invention.
Figure 5:
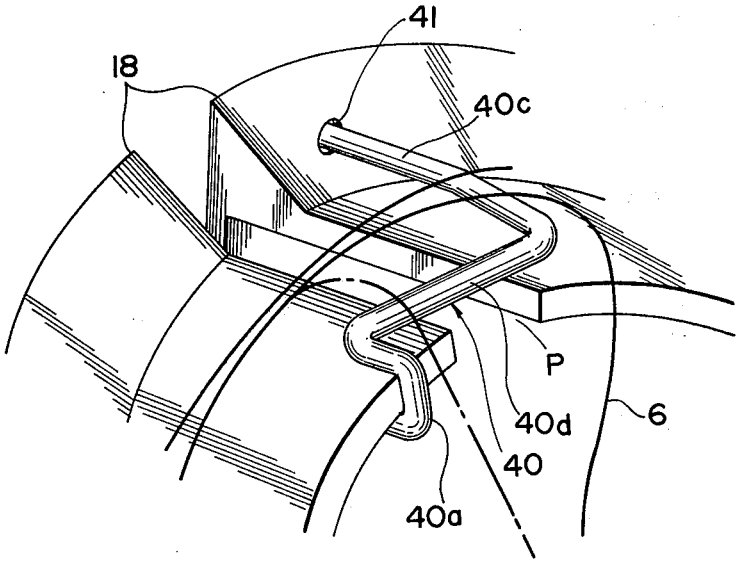
FIG. 5 is a perspective view of an essential part of FIG. 4.

FIGS. 4 and 5 illustrate a second embodiment of the weft detaining device according to the present invention, which is the same as the embodiment shown in FIGS. 1 to 3 with the exception that connecting members 40 are provided to connect the separate pieces 18 of the drum with each other. Each connecting member 40 is generally L-shaped and has an end section 40*a* which is formed into the shape of a generally C-shaped hook and the other end section 40*b* which is formed with a threaded section. The connecting member 40 is so set as to connect the adjacent separate pieces 18 of the drum 17 as best seen from FIG. 5, in which the end section 40*a* is securely fitted onto the edge of the cylindrical section 17*b* of the other drum separate piece 18 so that the generally C-shaped hook of the end section 40*a* grips the edge of the cylindrical section end F, and the end section 40*b* is inserted into an opening 41 formed, in the axial direction of the drum 17, at the slope surface of the frustoconical section 17*a* of a drum separate piece 18, the end section 40*b* being fixed in position by a nut 42 as shown in FIG. 4. In the state where the connecting member 40 is set in position to function, the main body of the L-shaped connecting member 40 has a first generally straight section 40*c* which is integral with the end section 40*b* and extends generally in the axial direction of the drum 17, and a second straight section 40*d* which is integrally connected to the firt straight section generally at right angles and extends in the direction parallel with the end faces F, R of the drum 17, the second straight section being in turn integral with the end section 40*a*. Thus, the second straight section 40*d* of the connecting member 40 extends over the aperture P between the adjacent separate pieces 18 of the drum 17 at the front end side of the cylindrical section 17*b*, i.e. at the side near the weft inserting nozzle 2.

With this arrangement, although the weft yarn 6 is slowly drawn out from the drum 17 slidably contacting with the peripheral surface of the drum 17 as in case of a manual weft picking, the weft yarn 6 does not drop into the aperture P between the adjacent separate pieces 18 in a manner indicated in phantom in FIG. 5, thereby preventing the weft yarn being drawn off from being caught by a corner of the separate piece 18. Accordingly, the weft yarn being drawn off can be smoothly moved from one drum separate piece 18 to another drum separate piece 18 along the connecting member 40. It will be understood that, during a normal operation of the loom, the weft yarn is drawn out from the drum at a high speed causing so-called ballooning phenomena of the weft yarn, there is no fear of the weft yarn being caught by any sections of the drum separate pieces 18.

Figure 6:
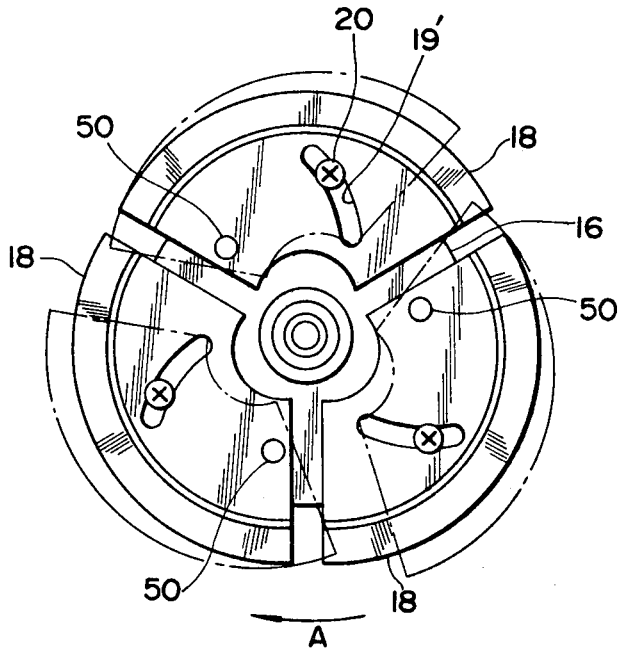
FIG. 6 is a side view of an essential part of a third embodiment of the weft detaining device according to the present invention.

FIG. 6 illustrates a third embodiment of the weft detaining device according to the present invention, in which each drum separate piece 18 is rotatably supported on the support member 16 by a pin 50 so as to be rotatable around the pin 50. The pin 50 is located at the rear part of each drum separate piece 18 relative to the central part thereof in the direction where the weft yarn 6 is drawn off, i.e. the direction of an arrow A. Each drum separate piece 18 is formed with an arcuate elongate opening 19' within which a small screw 20 is located and screwed into the support member 16 so as to guide each drum separate piece 18 to move to a position shown in phantom. Accordingly, each drum separate piece 18 can be fixed at the position shown in phantom by tightening the small screw 20.

Also with this arrangement, the weft yarn 6 can jump over the aperture P between the adjacent separate pieces 28 and smoothly move from one separate piece 18 to another separate piece 18, thereby preventing the weft yarn from being caught by any parts of the separate pieces 18 during the manual weft picking. It will be understood that also with this arrangement, the outer diameter of the drum 17 is variable to adjust the detaining amount of the weft yarn on the drum 17.

Figure 7:
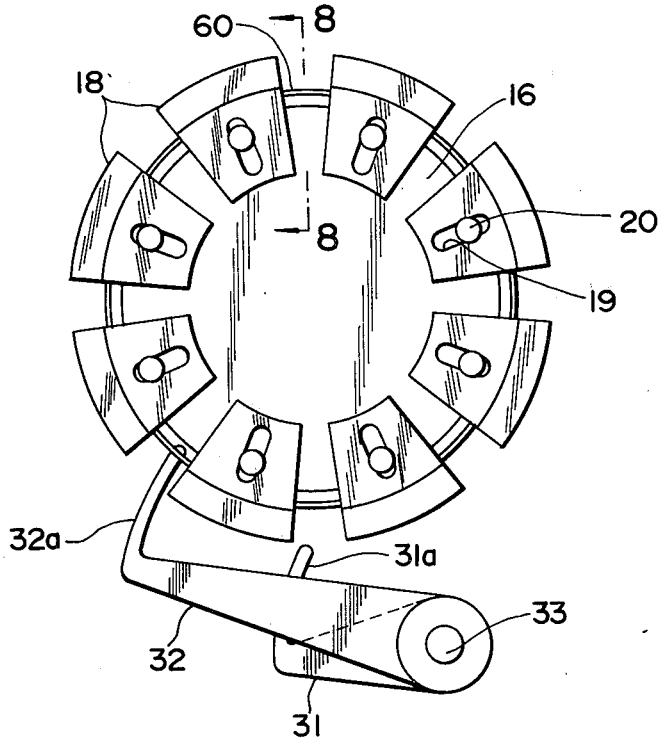
FIG. 7 is a side view of an essential part of a fourth embodiment of the weft detaining device according to the present invention.
Figure 8:
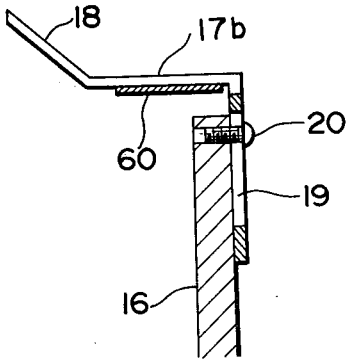
FIG. 8 is a cross-sectional view taken in the direction of the arrows substantially along the line 8—8 of FIG. 7.

FIGS. 7 and 8 illustrate a fourth embodiment of the weft detaining device according to the present invention, in which the number of the drum separate pieces 18 is increased as compared with the embodiments shown in FIGS. 1 to 3. While the number of the drum separate pieces 18 is eight in this instance, it will be understood that the number may suitably be able to be selected. Additionally, an arcuate spring plate 60 is provided between the adjacent two drum separate pieces 18 in a manner that an end section of the spring plate is fixed onto the inner surface of the cylindrical section 17*b* of a drum separate piece 18 whereas the other end of the spring plate contacts the inner surface of the cylindrical section of the other drum separate piece 18 by virtue of the elasticity of the spring plate 60. It is to be noted that one of the spring plates 60 is formed with a through-hole (not shown) into which the hook section 32*a* of the hook lever 32 is arranged to be able to project. In this connection, the hook section 31*a* of the first hook lever 31 is arranged to be able to project into between certain adjacent drum separate pieces 18. It will be appreciated from the above, that the plate springs 60 prevent the weft yarn from being caught by the corners of the drum separate pieces 18, accompanying with an advantageous effect that the weft yarn is prevented from moving down toward the inside of the drum, thereby preventing the weft yarn from being out of engagement with the hook sections 31*a*, 32*a* of the first and second hook levers 31 and 32.

Now, it will be appreciated that there is a possibility where the hook sections 31*a*, 32*a* cannot project into and withdraw from the respective through-holes 34, 35 when the location of each drum separate piece 18 is greatly varied so that the distance between the drum peripheral surface and the hook sections 31*a*, 32*a* becomes larger. However, in order to solve such a drawback, the weft detaining devices discussed hereinbefore are so constructed and arranged that the location of the shaft 33 on which the hook levers 31, 32 are rotatably mounted is adjustable. An example of such an arrangement will be explained on the embodiments shown in FIGS. 1 to 3, with reference to FIGS. 9 and 10.

While there is a pair of operating devices for the respective hook levers 31, 32, the construction of the operating devices is almost the same and therefore the explanation will be made on an operating device for the hook lever 31 for the purpose of simplicity of illustration. A claw 31*b* constituting the hook section 31*a* is fixed to the hook lever 31 by screws 51. The lower end of the hook 31 is rotatably and pivotally mounted through a needle bearing 70 on a small diameter section of the shaft 33. The shaft 33 is formed at its one end with a threaded section which is inserted into an elongate opening 54 of a bracket 53 and fixed thereon by a nut 55. The bracket 53 is in turn secured to the bracket 9. The reference numeral 68 denotes a stopper for the first and second hook levers 31, 32 and fixed onto the shaft 33 by a screw 69. The shaft 33 is formed at its outer surface with a flat section 52 on which a wrench can be fitted. The hook lever 31 is provided at its central section with a rod end 56 which is attached by a bolt 57. The rod end 56 is connected with a rod end 60 attached to a cam lever 58 through a turn buckle 61 and nuts 62, 62'. The cam lever 58 is provided at its central section with a cam follower 64 which is rotatably mounted on a bolt 63 fixedly attached on the cam lever 58. The cam lever 58 is swingably mounted on a support shaft 71 securely planted on the frame 1. The cam follower 64 is always in contact with a cam 65 by the bias of a spring 66 extended between the cam lever 58 and the bracket 53. The cam 65 is fixed on a rotatable shaft 67 which is rotatable in timed relation to the operational cycle of the loom. The cam 65 is formed with a high lobe section 65*a* and a low lobe section 65*b*.

With this arrangement, when the cam follower 64 is brought into contact with the low lobe section 65*b* of the cam 65 which is rotating with the progress of the operational cycle of the loom, the hook lever 31 swings toward the drum 17 so that its claw 31*b* projects into the through-hole 34. On the contrary, when the cam follower 64 is brought into contact with the high lobe section 56*a* of the cam 65, the hook lever 31 swings away from the drum 17 so that its claw 31*b* withdraws from the through-hole 34.

Now, if the drum separate pieces 18 are radially moved into the positions indicated in phantom to enlarge the outer diameter of the drum 17, the relationship between the through-holes 34, 35 and the hook sections 31*a*, 32*a* can be adjusted by first loosening the bolt 55 and secondly moving obliquely upward the hook levers 31, 32 and lastly adjusting the length of the turn buckles 61.

FIGS. 11 to 14 illustrate a fifth embodiment of the weft detaining device in accordance with the present invention. In this embodiment, an auxiliary air injection nozzle 75 is provided to introduce the weft yarn 6 supplied from the weft supply means (not shown) to the weft introduction hole 26 of the rotatable shaft 12. The air injection nozzle 75 is securely supported by a stay 76 which is connected to the bracket 9. As shown, the pulley 13 is fixedly mounted on the rotatable shaft 12 by means of a key 12A. Additionally, a pipe member 27A is screwed into an opening (no numeral) formed at the outer surface of the rotatable shaft 12 so that the inside of the pipe member 27A is in communication with the weft introduction hole 26. The pipe member 27A is fixed to the rotatable shaft 12 by means of a lock nut 27B. The weft guide member 29 is securely attached to the free end section of the pipe member 27A to guide the weft yarn supplied through the weft introduction hole 26 and the pipe member 27A onto the frustoconical section 17*a* of the drum 17.

As shown, the support member 16 comprises parallelly arraged rear and front annular flange sections 16*a*, 16*b* which are integrally connected with each other through a cylindrical section 16*c*. The support member 16 is rotatably mounted at the cylindrical section 16*c* on the front end section of the rotatable shaft 12. Each separate piece 18 is movably attached onto the rear annular section 16*a* of the support member 16 by means of a bolt 20A passing through the elongate opening 19 of the separate piece 18. The outer peripheral surface of cylindrical section 17*b* of the drum 17, in this case, is slightly tapered in the direction of the weft inserting nozzle 2 so that the weft yarn can be smoothly drawn out from the drum 17 during weft picking. A weight member 23A is disposed on the inside surface of one of separate pieces 18 and fastened in position together with the separate piece 18 onto the rear annular section 16*a* of the support member 16 as a single piece. It will be understood that the drum 17 can be maintained stationary in the state where the weight member 23A is positioned at the lower-most position. The front annular flange section 16*b* is located slightly projecting beyond the front end face F of the drum 17.

A disc-type weft guide member 77 is secured onto the flange section 16*b* of the support member 16 by means of small screws 78 and arranged coaxially with the drum 17. As shown, the peripheral edge 77*a* of the weft guide member 77 is located outside, in the radial direction, of the extension of the outer peripheral surface of the drum cylindrical section 17*b* at the front end face F thereof. Otherwise, the weft guide member peripheral edge 77*a* is located at the same level, in the radial direction, as with the extension of the drum cylindrical section outer peripheral surface at the front end face F. Additionally, the peripheral edge 77*a* of the weft guide 77 is rounded so that the weft yarn is prevented from being cut.

With this arrangement, when an operator pulls the weft yarn 6 at a position forward of the yarn guide 4 to draw out the weft yarn from the drum 17, the weft yarn 6 is drawn out contacting the peripheral edge 77*a* of the disc-type yarn guide 77 in which the weft yarn is extended between the drum 17 and the weft guide member peripheral edge 77*a*, so that the weft yarn is prevented from dropping into the space P between the adjacent separate pieces 18. It will be appreciated that, even in case where the separate pieces 18 are moved radially and outwardly in order to increase the outer diameter of the drum 17, such a weft yarn dropping prevention is effective by locating the weft guide peripheral edge 77*a* outside, in the radial direction, of the outer peripheral surface of the drum cylindrical section 17*b*.

Figure 15:
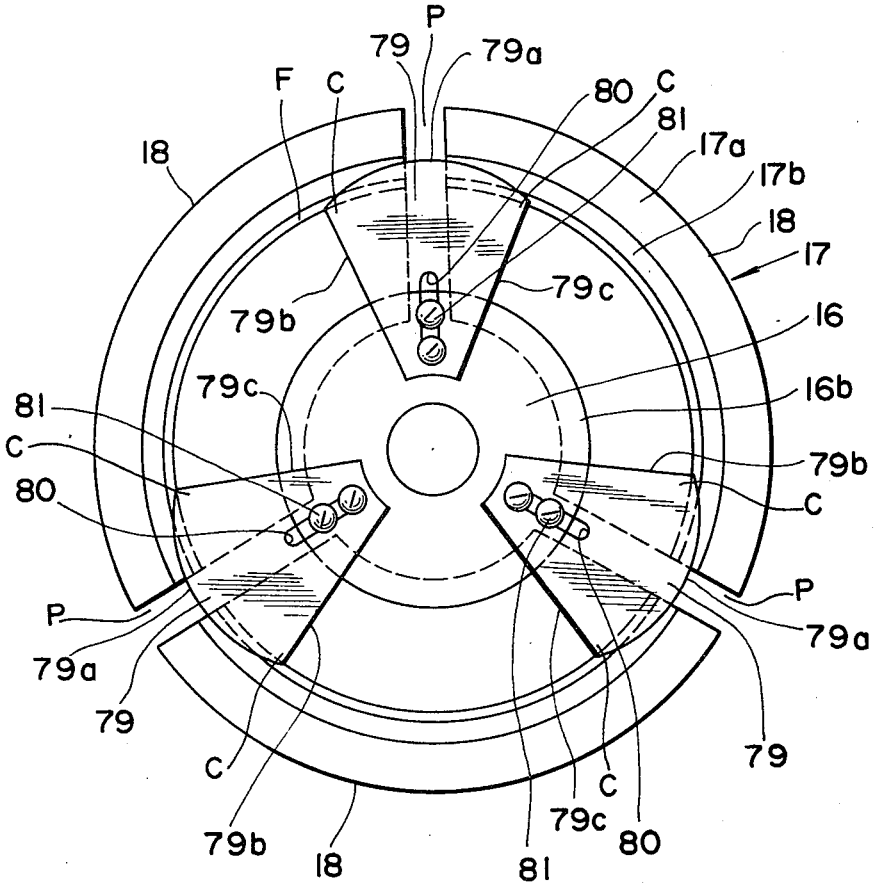
FIG. 15 is an enlarged side view similar to FIG. 13, but showing a sixth embodiment of the weft detaining device in accordance with the present invention.
Figure 16:
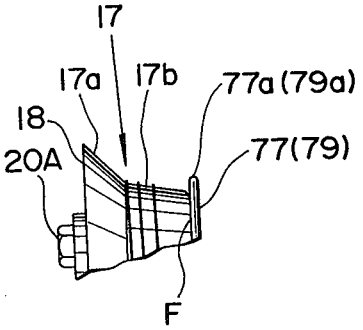
FIG. 16 is a partially cutaway view showing an modified example of locational relationship between the drum and the weft guide member.

FIG. 15 illustrates a sixth embodiment of the weft detaining device according to the present invention, which is similar to the embodiment of FIGS. 11 to 14 with the exception that three separate weft guide pieces 79 are used in place of a single weft guide member 77. Each weft guide piece 79 is generally of the sector form and securely attached onto the front flange section 16*b* of the support member 16 so as to be located extending over the space P between the adjacent separate pieces 18 as viewed from the axial direction of the drum 17. The weft guide piece 79 is formed with an elongate opening 80 which extends in the radial direction of the drum 17, and accordingly the weft guide piece 79 is secured onto the support member front flange section 16*b* by means of small screws 81 located within the elongate opening 80. It will be understood that the location where the weft guide piece 79 is fixed is adjustable by loosening the small screws 81. It is preferable that two opposite corners C of the sector form weft guide piece 79 are located, in the radial direction, inside of the outer peripheral surface of the drum cylindrical section 17*b* at the front end face F thereof. Each of the corners C is formed by an arcuate section 79*a* and each radius section 79*b*, 79*c* in order to prevent the weft yarn from being caught thereby during drawing-off of the weft yarn from the drum 17. In this embodiment, the arcuate 79*a* section is located outside, in the radial direction, of the extension (not shown) of the outer peripheral surface of the drum cylindrical section at the front end face F. Otherwise, the arcuate section may be located at the same level as with the same drum cylindrical section peripheral surface extension. It will be understood that, in the embodiments of FIGS. 11 to 16, the weft guide member 77 or each weft guide piece 79 may be secured in contact with the drum 17 or each drum separate piece 18 in a suitable manner, as shown in FIG. 16.

As will be appreciated from the above, according to the present invention, the weft detaining amount or weft length required for each picking is easily adjustable without preparing drums having different outer diameters or many adjusting members which will be disposed on the peripheral surface of a drum to adjust the outer diameter of the drum. This facilitates the operation and maintenance of a shuttleless loom weft detaining device, greatly contributing to economy in the operation and maintenance of the loom.

What is claimed is:

1. A weft detaining device of a shuttleless loom having a weft picking means, comprising:

a drum on which a weft yarn is wound a predetermined number of times prior to a weft picking through the weft picking means, said drum being constituted by a plurality of separate and independent drum pieces, the peripheral surface of each separate drum piece forming part of the peripheral surface of said drum;

stop means for maintaining said drum in a stationary state;

a support member on which each separate drum piece is securely supportable;

means defining first and second holes on the peripheral surface of said drum, said first and second holes being spaced from each other in the axial direction of said drum;

first and second hook levers formed respectively with hook sections, said first and second hook levers being constructed and arranged such that their hook sections are projectable respectively into said first and second holes to catch the weft yarn on the peripheral surface of said drum;

operating means for operating said first and second hook levers so as to project their respective hook sections at predetermined times in timed relation to an operational cycle of the loom;

means for allowing the locations of said separate drum pieces to be moved independently of each other relative to said support member so as to adjust the outer diameter of said drum; and means for releasably fixing said separate drum pieces relative to said support member.

2. A weft detaining device as claimed in claim 1, wherein said allowing means includes first means for guiding each drum separate piece in the radial direction of the drum, and second means for fastening said drum separate piece onto said support member.

3. A weft detaining device as claimed in claim 2, further comprising a connecting member which extends from one to another of two drum separate pieces which are located adjacent to each other, over an aperture to be formed between the adjacent two drum separate pieces.

4. A weft detaining device as claimed in claim 2, wherein said first means includes means defining a first elongate opening formed through said support member in the radial direction of said support member, and a pin fixed onto each separate piece and located within said first elongate opening, and said second means includes means defining a second elongate opening formed through said drum separate piece, said second elongate opening being parallel with said first elongate opening, and a screw located within said second elongate opening and screwed into said support member.

5. A weft detaining device as claimed in claim 1, wherein said allowing means includes third means for allowing each drum separate piece to be rotatable around a certain point of the drum separate piece which point is located rearward relative to a central section of said drum separate piece in a direction where the weft yarn is drawn off on the peripheral surface of said drum, and fourth means for fastening said drum separate piece onto said support member.

6. A weft detaining device as claimed in claim 5, wherein said third means includes a pin connected to each drum separate piece and whese axis is located said certain point, said drum separate piece being rotatable around said pin, and said fourth means includes means defining an arcuate opening formed through said drum separate piece, and a screw located within said arcuate opening and screwed into said support member so that said drum separate piece is rotatable around said pin in the direction along said arcuate opening.

7. A weft detaining device as claimed in claim 3, wherein said drum is formed with a frustoconical section whose outer diameter decreases in the direction toward the weft picking means, a generally cylindrical section which is integrally connected to a smallest-diameter part of said frustoconical section.

8. A weft detaining device as claimed in claim 7, wherein said connecting member has a first end section connected to an edge section of said cylindrical section of said one drum separate piece, a second end section securely connected to said frustoconical section of said another drum separate piece, a first generally straight section connected to said second end section and located parallel with the axis of said drum, and a second generally straight section which is integral at its one end with said first end section and at the other end with said first generally straight section, said second generally straight section being perpendicular to said first generally straight section and extends over said aperture formed between said one and another drum separate pieces.

9. A weft detaining device as claimed in claim 3, wherein said connecting member is a spring plate which is securely connected at its one end with the inner surface of said one drum separate piece and contacted at the other end with the inner surface of said another drum separate piece so as to extend over said aperture formed between said one and another drum separate pieces.

10. A weft detaining device as claimed in claim 1, further comprising adjusting means for allowing the locations of said first and second hook levers in connection with the movement of location of each drum separate piece so as to maintain a suitable locational relationship between the peripheral surface of said drum and the hook sections of said first and second hook levers.

11. A weft detaining device as claimed in claim 10, wherein said operating means includes first and second cams which are rotatable in accordance with the operational cycle of the loom, each cam being formed with a high lobe section and a low lobe section, first and second cam levers each being provided with a cam follower in contact with said cam, said first and second cam levers being swingable respectively in accordance with the rotation of said cam, and first and second connecting members said first connecting member connecting said first cam lever and said first hook lever, said second connecting member connecting said second cam lever with said second hook lever.

12. A weft detaining device as claimed in claim 11, wherein said adjusting means includes means defining an elongate opening within which a shaft is adjustably disposed, said first and second hook levers are rotatably mounted on said shaft, and length-varying means for varying the length of said connecting members.

13. A weft detaining device as claimed in claim 1, wherein said support member is mounted on a rotatable shaft so as to be rotatable relative to said rotatable shaft, said rotatable shaft being rotatable in timed relation with the operational cycle of the loom.

14. A weft detaining device as claimed in claim 1, wherein said stop means includes a first magnet securely disposed on the inside surface of said drum, and a second magnet securely disposed outside of said drum and located spaced apart from the peripheral surface of said drum, said second magnet being opposite to said first magnet so as to generate a magnetic attraction between said first and second magnets.

15. A weft detaining device as claimed in claim 13, wherein the axes of said drum, support member are in alignment with the axis of said rotatable shaft.

16. A weft detaining device as claimed in claim 1, wherein each drum separate piece is generally in the form of a sector in cross-section, in which an arcuate section of said drum separate piece constitutes the peripheral surface of said drum.

17. A weft detaining device as claimed in claim 1, further comprising a weft guide member securely disposed in close proximity to a first end face of said drum, said first end face being nearest to said weft picking means in the whole body of said drum, said weft guide member being formed with at least parts which face to apertures each of which is formed between said separate pieces of said drum, each of said parts having an arcuate section which is located at the same level as with or outside of the outer peripheral surface of said drum in close proximity to the first end face thereof in the radial direction of said drum.

18. A weft detaining device as claimed in claim 17, wherein said weft guide member is a disc-type and secured to said support member, said weft guide member being parallel and coaxially with said drum, the peripheral edge of said weft guide member being located outside of the peripheral surface of said drum at its first end face in the radial direction of said drum.

19. A weft detaining device as claimed in claim 17, wherein said weft guide member is separated into a plurality of weft guide pieces each of which is generally of a sector form and faces to said aperture of said drum, said weft guide piece being formed with an arcuate section which is located outside the extension of the outer peripheral surface of said drum at said aperture in the radial direction of said drum.

20. A weft detaining device as claimed in claim 19, wherein each weft guide piece is movable relative to said support member in the radial direction of said drum.

21. A weft detaining device as claimed in claim 19, wherein each weft guide piece is formed with two opposite corners each of which is defined by said arcuate section and a radial section, said corner being located inside of the outer peripheral surface of said drum in the radial direction of said drum.

22. A weft detaining device as claimed in claim 17, wherein said weft guide member is in contact with the first end face of said drum.

23. A weft detaining device of a shuttleless loom having a weft picking means, comprising:

a drum on which a weft yarn is wound a predetermined number of times prior to a weft picking through the weft picking means, said drum being constituted by a plurality of separate and independent drum pieces;

a support member on which each separate drum piece is securely supportable; and locating means for allowing the locations of said separate drum pieces to be movable relative to said support member so that the outer diameter of said drum is adjustable, said locating means including means for allowing each separate drum piece to be rotatable around a certain point of the separate drum piece which point is located rearward relative to a central section of said separate drum piece in a direction where the weft yarn is drawn off on the peripheral surface of said drum, and means for fastening said separate drum piece onto said support member.

24. A weft detaining device of a shuttleless loom having a weft picking means, comprising:

a drum on which a weft yarn is wound a predetermined number of times prior to a weft picking through the weft picking means, said drum being constituted by a plurality of separate and independent drum pieces;

a support member on which each separate drum piece is securely supportable;

locating means for allowing the locations of said separate drum pieces to be movable relative to said support member so that the outer diameter of said drum is adjustable, said locating means including first means for guiding each separate drum piece in the radial direction of the drum, and second means for fastening each separate drum piece onto said support member; and a connecting member which extends from one to another of two adjacent separate drum pieces over an opening formed therebetween.

25. A weft detaining device of a shuttleless loom having a weft picking means, comprising:

a drum on which a weft yarn is wound a predetermined number of times prior to a weft picking through the weft picking means, said drum being constituted by a plurality of separate and independent drum pieces;

a support member on which each separate drum piece is securely supportable; and locating means for allowing the locations of said separate drum pieces to be movable relative to said support member so that the outer diameter of said drum is adjustable, said locating means including first means for guiding each separate drum piece in the radial direction of the drum, said first means including means defining a first elongate opening formed through said support member in the radial direction of said support member, and a pin fixed onto each separate drum piece and located within said first elongate opening, and second means for fastening said separate drum piece onto said support member, said second means including means defining a second elongate opening formed through said separate drum piece, said second elongate opening being parallel with said first elongate opening, and a screw located within said second elongate opening and screwed into said support member.

26. A weft detaining device of a shutleless loom having a weft picking means, comprising:

a drum on which a weft yarn is wound a predetermined number of times prior to a weft picking through the weft picking means, said drum being constituted by a plurality of separate and independent drum pieces;

a support member on which each separate drum piece is securely supportable;

locating means for allowing the locations of said separate drum pieces to be movable relative to said support member so that the outer diameter of said drum is adjustable, said locating means including first means for guiding each separate drum piece in the radial direction of the drum, and second means for fastening each separate drum piece onto said support member; and a connecting member which extends from one to another of two adjacent separate drum pieces over an opening therebetween, said connection member being a spring plate which is securely connected at its one end with the inner surface of the one of said separate drum pieces and in contact at its other end with the inner surface of the other of said separate drum pieces.

27. A weft detaining device of a shuttleless loom having a weft picking means, comprising:

a drum on which a weft yarn is wound a predetermined number of times prior to a weft picking through the weft picking means, said drum being constituted by a plurality of separate and independent drum pieces;

a support member on which each separate drum piece is securely supportable;

locating means for allowing the locations of said separate drum pieces to be movable relative to said support member so that the outer diameter of said drum is adjustable; and a weft guide member securely disposed in close proximity to a first end face of said drum, said first end face being nearest to said weft picking means, said weft guide member being formed with portions which face openings provided between said separate drum pieces, each of said portions having an arcuate section which is located at the same level as or outside of the outer peripheral surface of said drum in close proximity to the first end face thereof in the radial direction of said drum.

28. A weft detaining device of a shuttleless loom having a weft picking means, comprising:

a drum on which a weft yarn is wound a predetermined number of times prior to a weft picking through the weft picking means, said drum being constituted by a plurality of separate and independent drum pieces;

a support member on which each separate drum piece is securely supportable;

means for allowing the locations of said separate drum pieces to be movable relative to said support member so that the outer diameter of said drum is adjustable; and a weft guide member securely disposed in close proximity to a first end face of said drum, said first end face being nearest to said weft picking means, said weft guide member being formed with parts which face towards openings formed between said separate drum pieces, each of said parts having an arcuate section which is located at the same level as or outside of the outer peripheral surface of said drum in close proximity to the first end face thereof in the radial direction of said drum, said weft guide member being in contact with the first end face of said drum.

* * * * *